United States Patent [19]

Bianchi

[11] Patent Number: 4,493,280

[45] Date of Patent: Jan. 15, 1985

[54] TWO-POSITION NEEDLE PLATE FOR SEWING MACHINES

[75] Inventor: Nereo Bianchi, Pavia, Italy

[73] Assignee: Necchi S.p.A., Pavia, Italy

[21] Appl. No.: 426,953

[22] Filed: Sep. 29, 1982

[30] Foreign Application Priority Data

Dec. 18, 1981 [IT] Italy ..... 42922 A/81

[51] Int. Cl.[3] ..... D05B 73/12

[52] U.S. Cl. ..... 112/260

[58] Field of Search ..... 112/13, 14, 168, 260

[56] References Cited

U.S. PATENT DOCUMENTS

| | | | |
|---|---|---|---|
| 452,819 | 5/1891 | Wheeler | 112/260 |
| 1,300,496 | 4/1919 | Shaw | 112/260 X |
| 1,998,587 | 4/1935 | McCann | 112/260 X |
| 2,920,593 | 1/1960 | Johnson | 112/260 |

FOREIGN PATENT DOCUMENTS

| | | | |
|---|---|---|---|
| 240895 | 9/1909 | Fed. Rep. of Germany | 112/260 |
| 740831 | 10/1943 | Fed. Rep. of Germany | 112/260 |
| 780482 | 8/1957 | United Kingdom | 112/260 |

*Primary Examiner*—Wm. Carter Reynolds

*Attorney, Agent, or Firm*—Stevens, Davis, Miller & Mosher

[57] ABSTRACT

A needle plate on the base of a sewing machine with a pin projecting from the plate lower surface. The pin is coil spring biassed upwardly to allow rotation of the plate about the pin and selection of one of two holes in the plate to cooperate with the needle. Flexure of a leaf spring, that engages the pin, will draw the needle plate into a fixed position on the base.

4 Claims, 9 Drawing Figures

TWO-POSITION NEEDLE PLATE FOR SEWING MACHINES

DESCRIPTION OF THE DISCLOSURE

The present invention relates to a two-position needle plate applied to the base of a sewing machine.

The two positions which the needle plate can assume on the base correspond to the two types of sewing customarily used, namely straight stitch and zig-zag stitch.

The convenience of using two different shapes for the hole provided in the plate for the passage of the needle results from the fact that the position of the surrounding fabric at the point of penetration of the needle must be maintained as much as possible so as to obtain a good closing of the stitch. It is therefore preferred, at least in the case of straight stitches, to use a circular needle hole having as small as possible a diameter. From circular hole for sewing with a straight stitch a change is made to an oblong hole when it is desired to carry out sewing with zig-zag stitches or embroidery in which the needle is imparted oscillating movements in a direction transverse to the transport of the fabric.

Two-position needle plates are already used on industrial sewing machines. The systems for maneuvering the plates are however impractical in the sense that they require a relatively long period of time and complex operations.

The object of the present invention is to provide an improvement and simplification of these existing solutions.

The solution developed in order to attain the purpose set forth is characterized by the fact that retention and operating means are provided by which the needle plate can be lifted from the operating position thereof in which it rests on the base to a height sufficient for it to be swung over the base without being disconnected from it and can alternatively be raised to a greater height in order to be disconnected and removed from the base.

Other advantages and features will become evident from the following description of a preferred embodiment of the invention and from the accompanying drawing in which.

Figure 1:
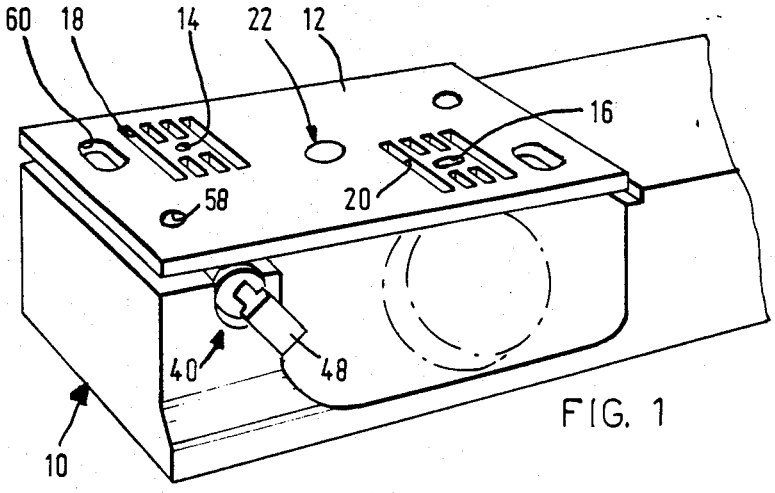
FIG. 1 is a perspective view of the needle plate and the base of the sewing machine, with the needle plate resting against the base.
Figure 2:
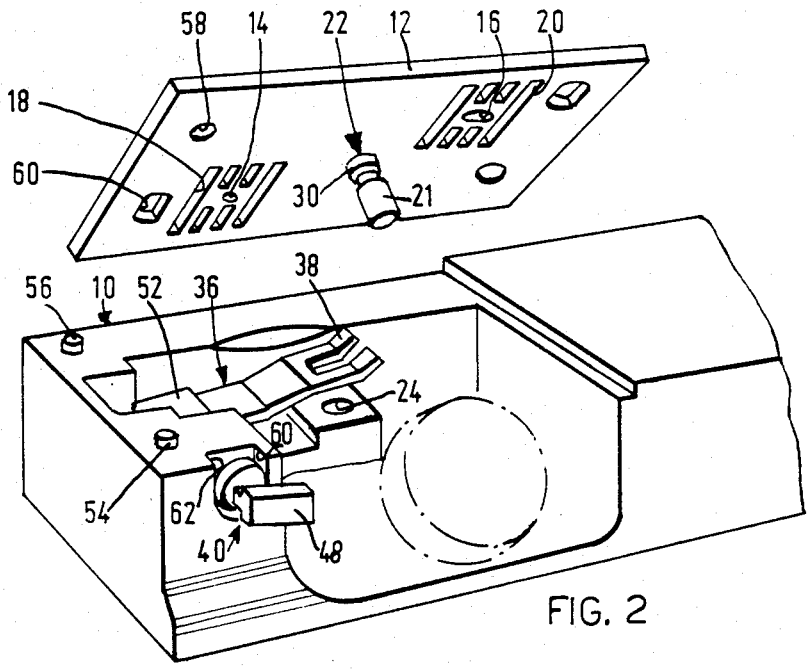
FIG. 2 is a perspective view of the needle plate and base with the needle plate lifted from the base.

In FIGS. 1 and 2, 10 is the end portion of the free arm of a sewing machine covered on top by the needle plate 12. This free arm constitutes the base of the sewing machine and contains the stitch-forming members in customary manner.

The needle plate 12 is provided with two groups of grooves composed of holes 14 and 16 for the passage of the needle and of the rectangular openings 18 and 20 for the passage of the teeth of the feed-dog of the fabric feed system. The groups of grooves are placed in symmetrical position with respect to a central pin 22 provided rigidly on the needle plate 12 and extending below it.

The lower part 21 of the pin 22 connects with a circular hole 24 provided in the arm 10 annd is urged upwardly by a coil spring 26 (FIG. 3) resting against the bottom of the hole 24. In its intermediate part the pin 22 has a portion 28 of smaller diameter which together with the lower portion 21 and the upper portion 30 forms two shoulders shaped as a circular ring, 32 and 34 respectively.

A leaf spring 36 rests at one end on the inside of the base 10 and is held in position by a retaining pin 37. The opposite end 38, shaped as a fork, is coupled with the portion of smaller diameter 28 of the pin 22.

Figure 6:
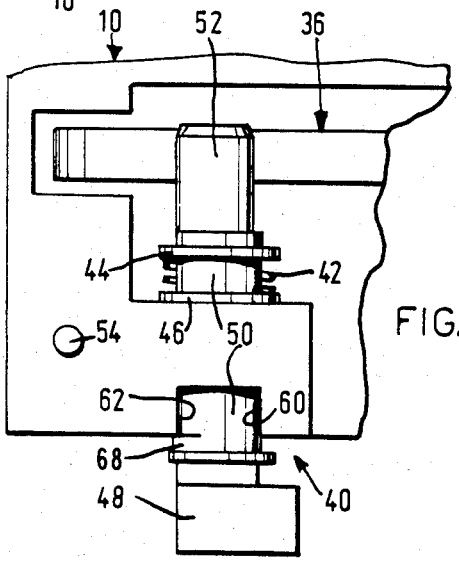
FIGS. 6 and 8 show a detail of FIGS. 1 and 2 in two different operating positions.
Figure 8:
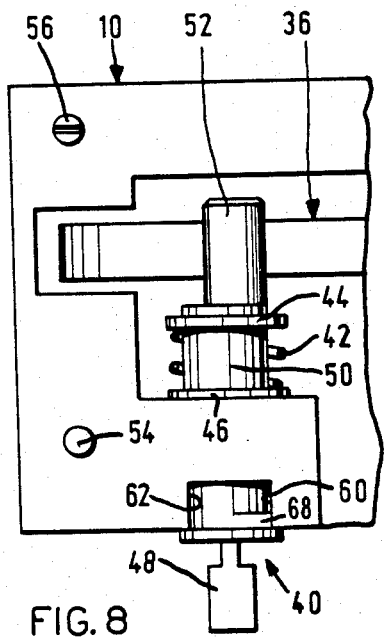
Figure 9:
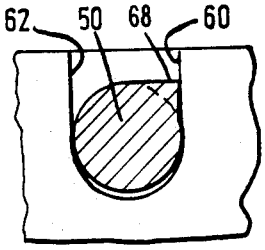

Mounted for rotation within the arm 10 of the machine there is provided an operating member 40 (FIGS. 6 and 8) arranged transversely to the spring 36.

Figure 3:
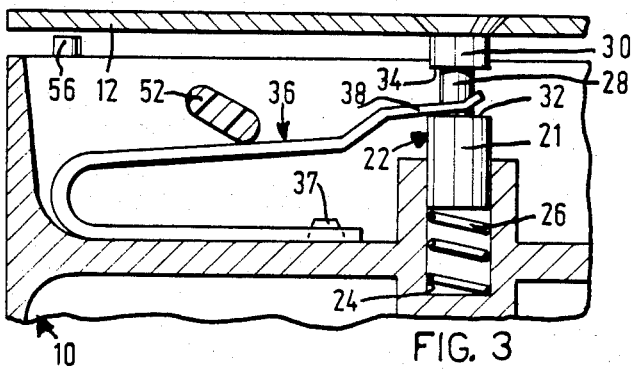
FIGS. 3, 4 and 5 show in side elevation three different positions of the plate with respect to the base of the sewing machine.
Figure 7:
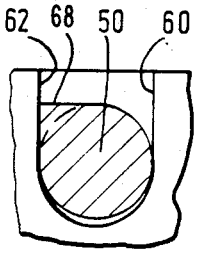
FIGS. 7 and 9 are detailed views of FIG. 8.
Figure 5:
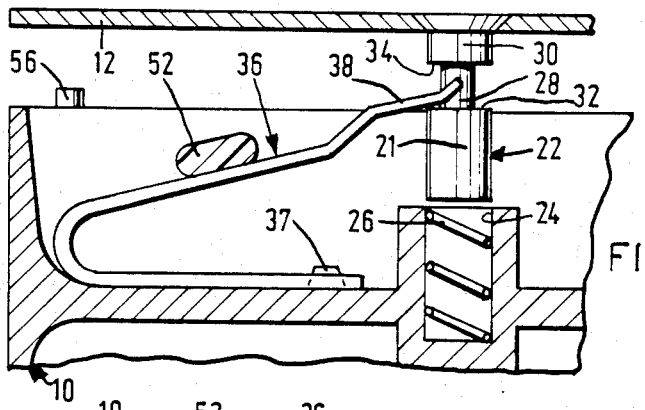
Figure 4:
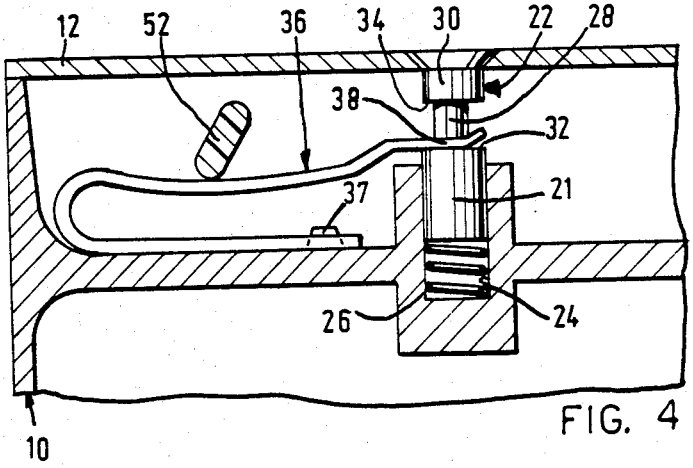

The member 40 may carry out, in its support seat, axial displacements against the action of a coil spring 42 wound between a shoulder 44 provided on said member and a second shoulder 46 provided within the arm 10. The member 40 has at one end a handle 48, a cylindrical central body 50 and at the opposite end a portion 52 of a substantially elliptical cross-section. The end portion 52 is placed on top of the leaf-spring 36 and, depending on its angular position, will exert a greater or lesser pressure on the spring (FIGS. 3, 4 and 5).

The structure of the operating mechanism for the needle plate will be described below; for the time being it is sufficient to point out that when the angular position of the portion 52 is that in which the spring 36 is practically unstressed (FIG. 5), the needle plate rises a good distance above the upper plane of the arm 10 due to the combined action of the spring 26 which pushes the pin 22 upwardly and the action of the spring 36.

Two other angular operating positions of the member 40 are furthermore defined. In one of them (FIG. 3) it exerts a slight pressure on the spring 36 so as partially to overcome the combined upward thrust of the spring 26 and of the spring 36 and cause a smaller raising of the plate 12 than in FIG. 5. In the other angular position of the member 40 (FIG. 4), the portion 52 presses more strongly against the spring 36 so as definitely to overcome the upward force exerted by the spring 26.

The needle plate 12 is thus held firmly fixed on the upper surface of the arm 10 in its precisely determined and adjustable operating position by the coupling of the stop pin 54 and the adjustable eccentric pin 56 with the seats 58 and 60 on the plate 12. By maneuvering the pin 56 it rotates eccentrically and forces the needle plate 12 to carry out small displacements of fine adjustment until it has reached its exact position.

The two angular positions mentioned above are defined by a tooth 68 provided on the cylindrical portion 50 of the element 40 which cooperates with the two shoulders 60 and 62 provided on opposite sides on the arm 10 (FIGS. 2, 6, 7, 8, 9). In its angular position shown in FIG. 4, the portion 52 of the member 40 exerts a strong pressure on the spring 36 and the needle plate 12 is held in contact with the upper surface of the arm 10 in normal operating position. If the handle 48 is turned until the tooth 68 is against the opposite vertical wall 62 (FIG. 7), the portion 52 exerts a lesser pressure on the spring 36. The plate, urged by the action of the said spring 36 and the action of the spring 26, rises with respect to the upper plant of the arm 10 by a small amount (FIG. 3) which, however, is sufficient to permit it to turn 180° around the axis of the pin 22 and to bring the desired replacement needle hole for the type of sewing (zig-zag or straight stitch) below the needle. When the plate 12 has been swung into the new sewing position, the handle 48 will rotate so as to reassume the condition shown in FIG. 4 and again fasten the plate onto the upper plane of the arm. If it is now desired to remove the needle plate 12 from the arm 10, the handle 48 is pulled back, overcoming the action of the spring 42.

It its axial-rearward course (FIG. 6), the tooth 68 of the cylindrical body 34 of the element 30 comes into a free zone of the casting where the closure walls 60 and 62 are lacking. In this way the handle can be rotated until the eccentric portion 52 is caused to assume the position shown in FIG. 5. Under the urging of the spring 26 and of the spring 36, the needle plate which is fastened to the pin 12 will be displaced thus above the upper plane of the arm 10 to a height from same such that it can be maneuvered in order to disengage the portions 28 of the pin 21 from the arms of the fork 38 and can be removed completely from the arm 10 of the sewing machine.

I claim:

1. A two-position needle plate and base of a sewing machine, said plate being provided with two needle holes of different shape which can be brought alternatively into coincidence with the path of the vibrations of the needle by the rotation of said needle plate, and retaining and operating means by which said needle plate can be raised from its operating position in which it rests on the base to a height sufficient so that it can be rotated above said base without being disconnected from it and alternatively can be raised to a greater height so as to be disconnected and removed from said base, said retaining and operating means comprise a pin connected centrally to said needle plate and extending perpendicularly downward, a first spring element adapted to exert an upwardly vertical thrust on said pin, a second leaf spring element adapted to exert an action opposing the upward thrust of said first spring element, and a manual control member provided on said base in order to regulate the intensity of said opposing action exerted by said second leaf spring element.

2. The needle plate according to claim 1, wherein said base defines a cylindrical hole therein and said first spring element consists of a spiral spring housed in said cylindrical hole.

3. The needle plate according to claim 1, wherein said second leaf spring element is fastened at one of its ends to the base of the sewing machine and connected by its other end to said pin rigidly attached to the needle plate.

4. The needle plate according to claim 1, wherein said manual control member is shaped in such a manner as to exert two different pressures on said leaf spring element when it is brought by the operator into two differently placed angular positions.

* * * * *